US008850832B2

(12) United States Patent
Lingrey et al.

(10) Patent No.: US 8,850,832 B2
(45) Date of Patent: Oct. 7, 2014

(54) APPARATUS AND METHOD FOR INSTALLATION BY UNLICENSED PERSONNEL OF A PRE-CHARGED, DUCTLESS HEATING/COOLING SYSTEM

(75) Inventors: David J. Lingrey, San Antonio, TX (US); Charles Anthony Wheeler, Jr., Universal City, TX (US); Heath James Hoselton, San Antonio, TX (US); Kevin L. Eicher, Suguin, TX (US)

(73) Assignee: Friedrich Air Conditioning Co, Ltd., San Antonio, TX (US)

( * ) Notice: Subject to any disclaimer, the term of this patent is extended or adjusted under 35 U.S.C. 154(b) by 189 days.

(21) Appl. No.: 13/593,719

(22) Filed: Aug. 24, 2012

(65) Prior Publication Data

US 2012/0318005 A1 Dec. 20, 2012

Related U.S. Application Data

(63) Continuation-in-part of application No. 13/013,547, filed on Jan. 25, 2011.

(51) Int. Cl.
*F25B 45/00* (2006.01)
*F24F 1/20* (2011.01)
*F24F 1/26* (2011.01)

(52) U.S. Cl.
CPC .... *F24F 1/26* (2013.01); *F24F 1/20* (2013.01)
USPC ..... 62/77; 62/262; 62/498

(58) Field of Classification Search
CPC ..... F24F 1/26; F24F 1/20; F25B 1/10; F25B 13/00; F25B 9/08
USPC ..... 62/77, 498, 262; 174/70 R
See application file for complete search history.

(56) References Cited

U.S. PATENT DOCUMENTS

| | | | | | |
|---|---|---|---|---|---|
| 2,324,313 | A * | 7/1943 | Meyerhans | 62/427 |
| 3,438,219 | A * | 4/1969 | Brugler | 62/262 |
| 3,611,743 | A * | 10/1971 | Manganaro | 2/263 |
| 3,841,110 | A * | 10/1974 | Schuster et al. | 62/427 |
| 4,184,661 | A * | 1/1980 | Kushner et al. | 251/82 |
| 4,835,981 | A * | 6/1989 | Rinholen | 62/229 |
| RE33,943 | E * | 6/1992 | Arzberger et al. | 62/127 |
| 6,662,587 | B2 * | 12/2003 | Rembold et al. | 62/292 |
| 7,148,423 | B2 * | 12/2006 | Masuda et al. | 174/125.1 |
| 7,516,942 | B2 * | 4/2009 | Grau et al. | 251/309 |
| 8,608,514 | B2 * | 12/2013 | Kolkman | 439/685 |
| 2003/0192335 | A1 * | 10/2003 | Rembold et al. | 62/292 |
| 2005/0104025 | A1 * | 5/2005 | Grua | 251/309 |
| 2005/0106899 | A1 * | 5/2005 | Morlok | 439/1 |
| 2007/0093977 | A1 * | 4/2007 | Yuan et al. | 702/58 |
| 2009/0065233 | A1 * | 3/2009 | Hansen et al. | 174/66 |
| 2010/0019776 | A1 * | 1/2010 | Folts et al. | 324/539 |
| 2010/0149707 | A1 * | 6/2010 | Folts et al. | 361/58 |
| 2011/0308814 | A1 * | 12/2011 | Menotti | 166/378 |

* cited by examiner

*Primary Examiner* — Mohammad M Ali
(74) *Attorney, Agent, or Firm* — Gunn, Lee & Cave, P.C.

(57) ABSTRACT

A pre-charged heating/cooling system is shown for installation by unlicensed personnel. An outside unit includes an outside coil, outside fan, compressor and a reversing valve. An inside unit has an inside coil, inside fan for drawing air through the inside coil and discharging the conditioned air into the enclosed space, and a power cord connection. A cable sheath contains all connections from the inside unit to the outside unit with electrical connections being secured in position on the outside unit by a cover and a bracket. An expandable window sill holds and seals the cable sheath in a window opening.

15 Claims, 18 Drawing Sheets

APPARATUS AND METHOD FOR INSTALLATION BY UNLICENSED PERSONNEL OF A PRE-CHARGED, DUCTLESS HEATING/COOLING SYSTEM

CROSS REFERENCE TO RELATED APPLICATIONS

This is a continuation-in-part of U.S. patent application Ser. No. 13/013,547, filed on Jan. 25, 2011.

BACKGROUND OF THE INVENTION

1. Technical Field

This invention relates to a heating/cooling system and, more particularly, to installation by unlicensed personnel of a pre-charged, ductless heating/cooling system.

2. Description of the Prior Art

Providing heat in the winter and cooling in the summer has been a concern to man since the earliest of recorded time. About one hundred years ago, electric energy came into common use as a means of providing air conditioning and heating. While initially air conditioning or heating was performed by separate devices, after a period of time, reverse cycling units were developed to provide heating, ventilation, and air conditioning, which systems were referred to as HVAC systems.

In a typical HVAC system, there is an indoor coil and an outdoor coil with an expansion valve and compressor located there between. A reversing valve is also included between the outdoor coil and the indoor coil so the system can be switched between cooling or heating. In the cooling cycle, the outdoor coil is the condenser and the indoor coil is the evaporator. In the heating cycle, the outdoor coil is the evaporator and the indoor coil is the condenser. Fans will move the air through both the indoor coil and the outdoor coil. If neither heating or cooling is necessary, the fan for the indoor unit can still provide air circulation within the enclosed space.

In a typical central HVAC unit, air is drawn through the indoor coil and flows into a duct system for delivery throughout the enclosed space. The ducts will have outlets that can be opened or closed as desired to provide the appropriate amount of conditioned air. The connection of the ducts from the indoor coil to the various rooms in the enclosed space to be heated or cooled has always required a lot of manpower and effort. In recent years, especially in countries having relaxed laws and regulations, there has been a trend to provide ductless HVAC systems. In the ductless systems, the refrigerant lines would run between the indoor and outdoor units, but there would not be ducts inside the conditioned space to deliver air from the indoor coil to the various rooms being conditioned. Instead, a fan would draw air through the indoor coil to be discharged directly into the room. If more than one room was to be conditioned, multiple indoor coils would be used. The multiple indoor coils could be connected in parallel so that each could act as an evaporator if cooling is necessary or a condenser if heating is necessary.

In the more developed countries that have codes and regulations covering how HVAC systems are to be wired and operated, electrical codes and regulations mandate the use of an electric disconnecting means for safety reasons. To put in the electrical connection requires a licensed electrician. Also, to charge an HVAC system with a refrigerant once it is installed requires another licensed individual. If a need for these licensed individuals can be eliminated while meeting necessary codes and regulations, then an HVAC system could be installed by unlicensed personnel.

BRIEF SUMMARY OF THE INVENTION

It is an object of the present invention to provide a ductless HVAC system.

It is another object of the present invention to eliminate the need for licensed individuals when installing a ductless HVAC system.

It is another object of the present invention to provide a pre-packaged, pre-charged ductless HVAC system for installation by unlicensed personnel.

It is still another object of the present invention to provide a method and apparatus for connecting the outdoor unit of an HVAC system that would eliminate the need for licensed personnel but, instead, can be installed by unlicensed personnel.

It is yet another object of the present invention to provide:

(1) a cable sheath for connecting the inside unit to the outside unit;

(2) an expandable window sill for passing the cable sheath through a window; and (3) a cord retention bracket for holding the outside electrical line when disconnected.

A pre-packaged HVAC system is provided that has an outdoor unit complete with a pre-drilled mounting skid. The outdoor unit will include an outdoor coil, compressor and reversing valve. The outdoor unit will be pre-charged with a refrigerant and connects to a dual-refrigerant quick connector that is accessible under a covering box. Also under the covering box is a clamped-down male electrical connection. An electrical disconnect cover will clamp any connecting electrical cable in place. The electrical cable when clamped in place cannot accidentally fall down into water or any other substance to create a danger of electrocution of individuals working thereon.

The outdoor unit is shipped with a lightweight pad, which lightweight pad can then be used to mount the outdoor unit thereon outside of the conditioned space. The lightweight pad may rest directly on the ground.

The inside unit has a mounting bracket that can be attached to the wall. The inside unit will have a cable sheath, which cable sheath will include inside thereof a pair of refrigerant lines, an electrical cable, and a drainage line to dispose of condensate.

Typically, the indoor unit is mounted on the wall with a hole through the wall located immediately there behind. The mounting bracket is secured to the wall adjacent to the hole. The cable sheath is inserted through the hole and the indoor unit is secured to the mounting bracket. The pair of refrigerant lines would be connected to the dual-refrigerant connector on the outdoor unit. The electrical cable would be clamped down by the electrical disconnect cover. The male connector on the end of the electrical cable is connected to the female electrical connector inside of the electrical disconnect cover.

If filters have not already been inserted inside of the inside unit, filters are inserted. Thereafter, the inside unit is plugged in and turn ON, either with a switch thereon or with a remote control. The electrical connection from the inside unit connects through the electrical cable, the male connector, the female electrical connector to the outside unit. Because the electrical cable is clamped down by the electrical disconnect cover so that the electrical cable cannot fall into water or other fluids to cause electrocution or shock, and because the connection is contained within an electrical disconnect cover, the connection is acting as a factory installed disconnect.

The drain line may go all the way to the end of the cable sheath and drip any condensation on the ground, or the drain line could extend to any other location desired by the end user.

The cable sheath may have a number of different designs, including a large opening to accommodate a suction line, a liquid line and an electrical line and a smaller opening to accommodate a condensate drain tube. Alternatively, the condensate drain tube may be formed as a part of the cable sheath that may be pulled away from the cable sheath on either end thereof. Also, the cable sheath could have multiple air pockets running the length thereof to provide insulation for the suction line.

If the cable sheath connects from the inside unit to the outside unit through a window opening, an expandable window sill may be used. The expandable window sill has a telescoping inner extension and outer extension. On one end of the inner extension, a notch is cut into which the sheath is placed. Around the sheath is a pass-through gasket to hold the sheath in place. On all sides of the expandable window sill is located sealing material to prevent leakage there around.

At the outside unit, a cord retention bracket will hold the outside electrical cord in place when disconnected. This keeps the outside electrical cord from dropping down and causing an electrical short. The cord retention bracket not only holds the outside electrical cord in place, but also holds the cover on the outside unit in position. The cover protects the outside electrical connection and the quick disconnect from the elements.

The outdoor electrical disconnect is provided in the lineset and, therefore does not require the installation of an additional circuit disconnect. Also, the refrigerant lines are pre-charged, thus not requiring the evacuation and charging of the refrigerant lines.

BRIEF DESCRIPTION OF THE DRAWINGS

FIG. 21 is a sectional perspective view illustrating an inside unit, outside unit with an expandable window sill below a window for the cable sheath to extend there through.

DESCRIPTION OF THE PREFERRED EMBODIMENT

Figure 1:
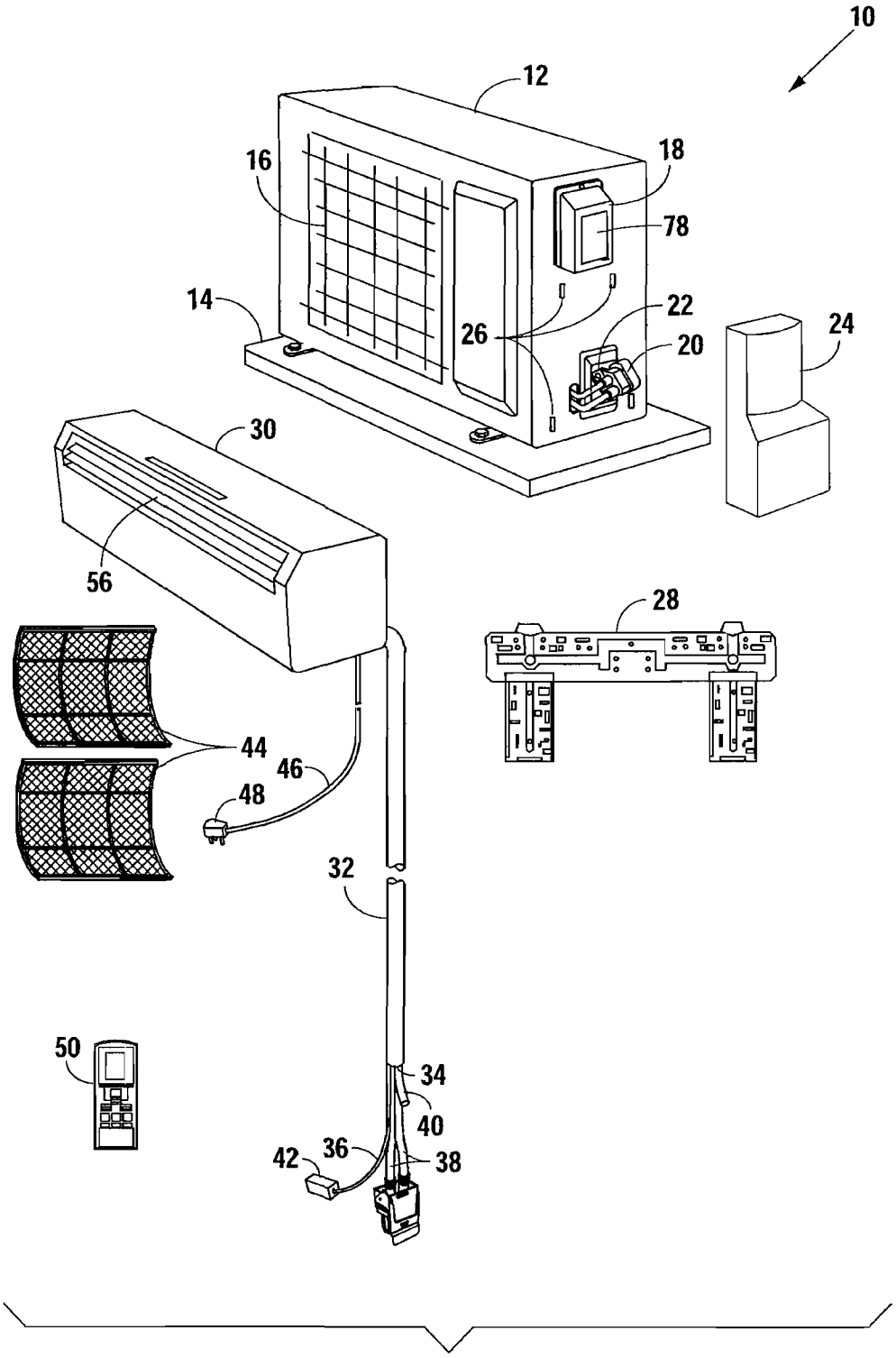
FIG. 1 is a pre-charged, ductless heating/cooling system for installation by unlicensed personnel.

Referring now to FIG. 1, a perspective view is shown for a ductless heating/cooling system that can be installed by unlicensed personnel, which system is generally referred to by the reference numeral 10. The system 10 includes an outdoor unit 12 mounted on a lightweight pad 14. The lightweight pad 14 may be placed directly on the ground outside an enclosed space and used to support the outdoor unit 12. The lightweight pad 14 may also be used as support during shipment of the system 10.

Within the outdoor unit 12, behind the grill 16 is located the outdoor coil. The outdoor unit 12 includes a compressor (not shown) and/or a reversing valve (not shown). On one end of the outdoor unit 12 is mounted an electrical disconnect cover 18 and dual-refrigerant connector 20. Dual-refrigerant connector 20 is held in position by mounting bracket 22. The dual-refrigerant connector 20 is contained inside of covering box 24. Covering box 24 is held in position by tabs (not shown) inserted into slots 26.

The system also includes a mounting bracket 28 that is attached to the inside wall wherever the inside unit 30 is mounted. Extending from the back of the inside unit 30 is a cable sheath 32. A hole is cut in the wall directly behind the inside unit 30 to allow the cable sheath 32 to extend there through. Extending from the lower end 34 of the cable sheath 32 is the electrical cable 36, dual refrigerant lines 38 and drain line 40. Drain line 40 is included within the cable sheath 32, but in this preferred embodiment, the drain line 40 extends to the lower end 34 of the cable sheath 32. On the end of the electrical cable 36 is a male locking connector 42.

Inside the enclosed space (not shown in FIG. 1), if filters 44 have not been inserted into the inside unit 30, the filters 44 are inserted prior to use. Power cord 46 is plugged into any suitable outlet (not shown in FIG. 1) by electrical plug 48. A remote control 50 may then be used to turn ON the inside unit 30, which in turn supplies power via electrical cable 36 and female locking connector 42 to the outside unit 12.

Figure 2:
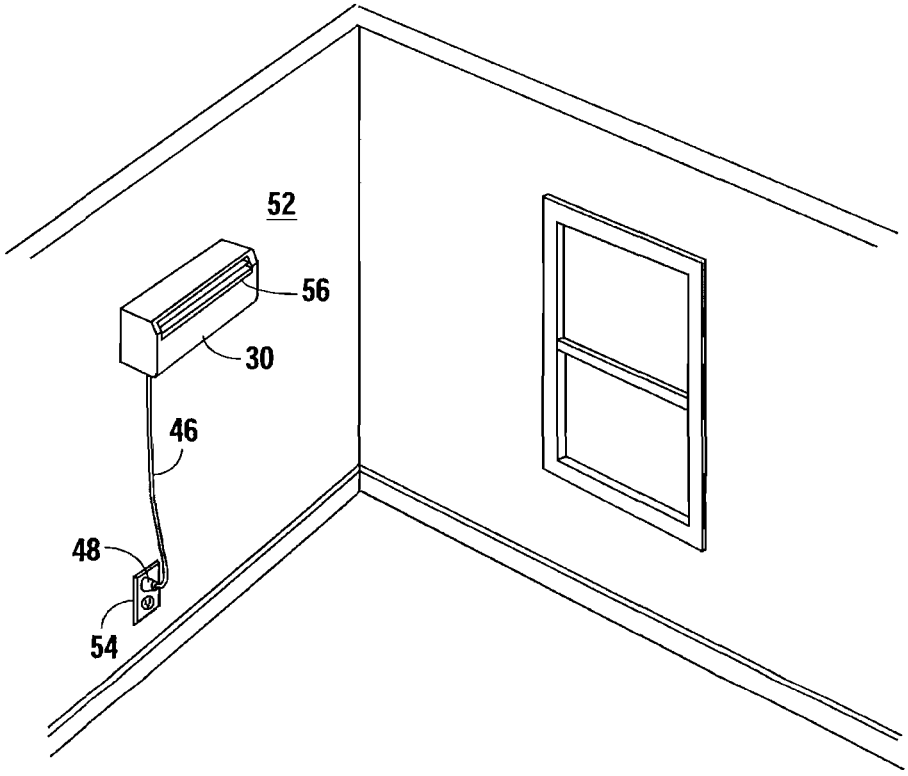
FIG. 2 is a perspective view of the inside unit shown in FIG. 1 as installed in a ductless system.

Referring now to FIG. 2, the typical mounting of the inside unit 30 on an inside wall 52 of an enclosed space is illustrated. The inside unit 30 is connected through power cord 46 and electrical plug 48 to wall outlet 54. Therefore, the wall outlet 54 is providing the power for not only the inside unit 30, but also the outside unit 12 (see FIG. 1).

In operation, a fan (not shown) will draw air up through the inside unit 30, which air is conditioned (either heated or cooled) and discharged into the enclosed space through inside louvers 56. Likewise, a fan (not shown) will draw air through the grill 16 of the outside unit 12, which air will subsequently be discharged to the atmosphere.

Figure 3:
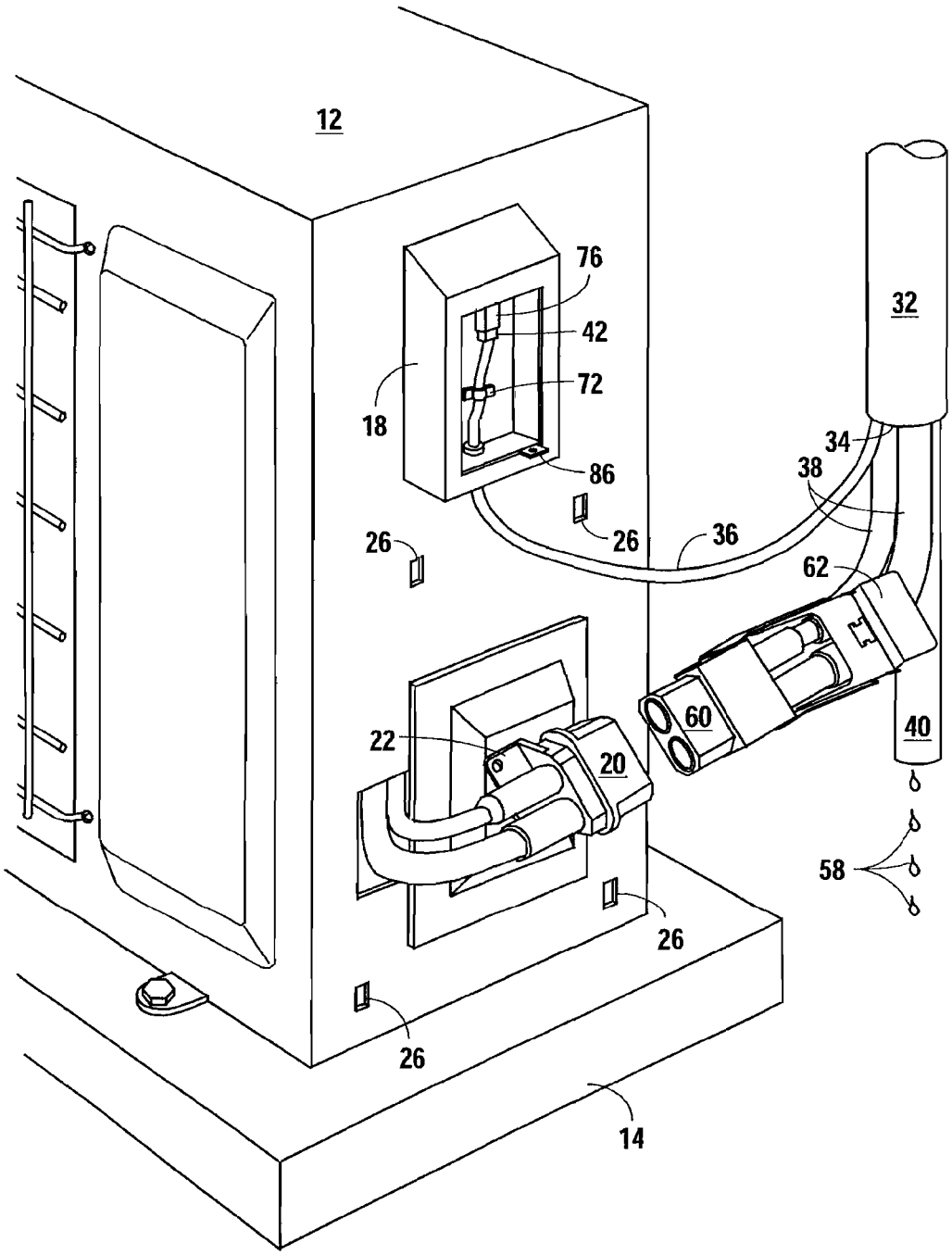
FIG. 3 is a partial perspective view of the outside unit shown in FIG. 1 showing the refrigerant connection, electrical connection and drain of a ductless system.

Referring now to FIG. 3, the end of the outside unit that has the connections thereto is shown, but with the covering box 24 removed. Extending out of the lower end 34 of the cable sheath 32 is the electrical cable 36, dual refrigerant lines 38 and drain line 40. While it may depend upon the environment, the drain line 40 may simply allow condensate to drip on the ground as illustrated by drops 58.

The dual-refrigerant connector 20, which is held in position by mounting bracket 22 connects to the dual-refrigerant line 38 by quick refrigerant connector 60. By use of the quick refrigerant connector 60 with the locking lever 62, the dual-refrigerant connector 20 can be connected to the dual refrigerant lines 38, even though both are fully charged with refrigerant.

Figure 7:
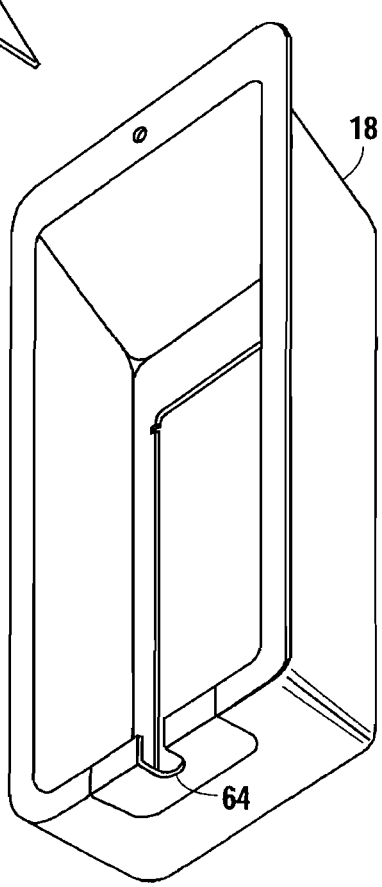
FIG. 7 is an inside perspective view of the electrical disconnect cover of ductless system.
Figure 8:
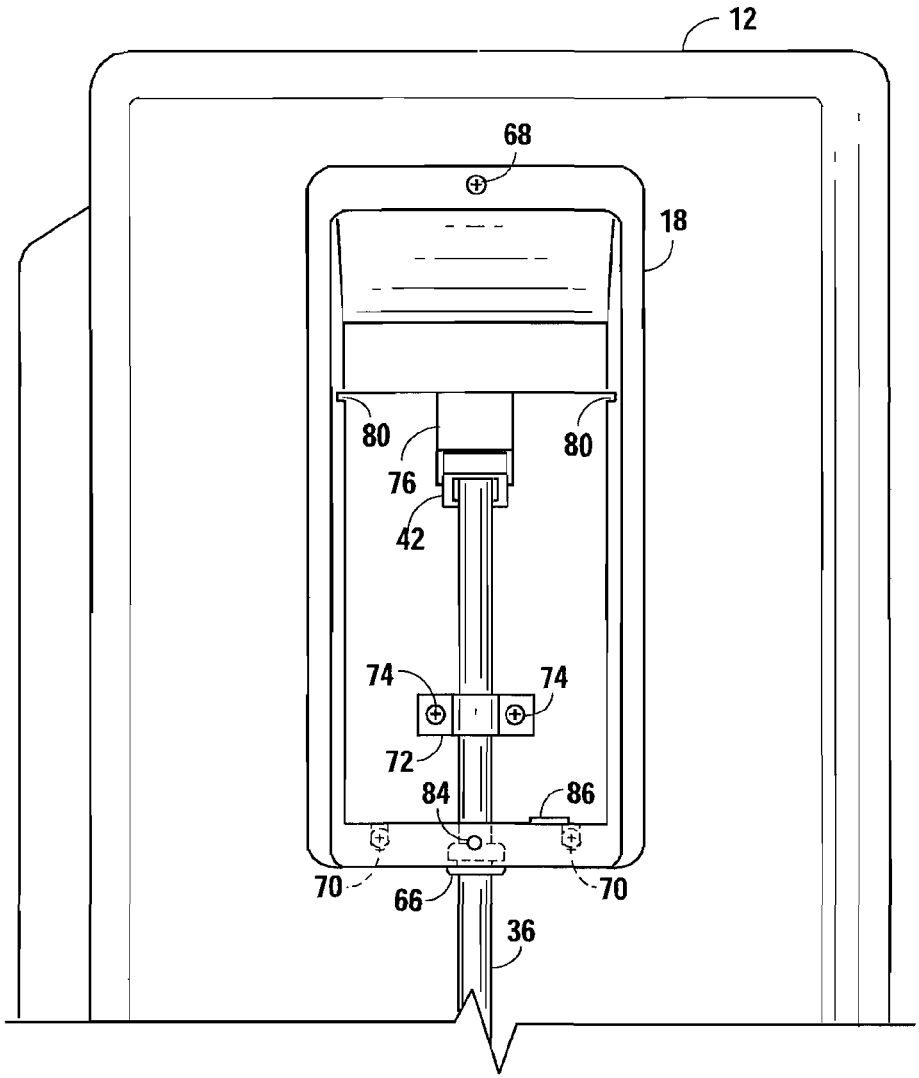
FIG. 8 is a partial elevational view showing the electrical cable connection to the outdoor unit of the ductless system as shown in FIG. 1, but with the cover door removed.

Referring now to FIG. 3 in combination with FIGS. 6, 7 and 8, the electrical disconnect cover 18 will be explained in more detail. The lower side of the electrical disconnect cover 18 has a mouse hole 64 therein. Formed integrally with the electrical cable 36 is a rubber grommet 66 that is secured inside of the mouse hole 64. When the electrical disconnect cover 18 is secured in position by screws 68 and 70 (see FIG. 8), the electrical cable 36 is held in place by the rubber grommet 66 being trapped in the mouse hole 64. Inside of the electrical connector cover 18, cable 36 is further held in position by clamp 72 being secured there across by screws 74. On the end of the electrical cable 36 is a female locking connector 42 that mates and locks with male locking connector 76.

Figure 6:
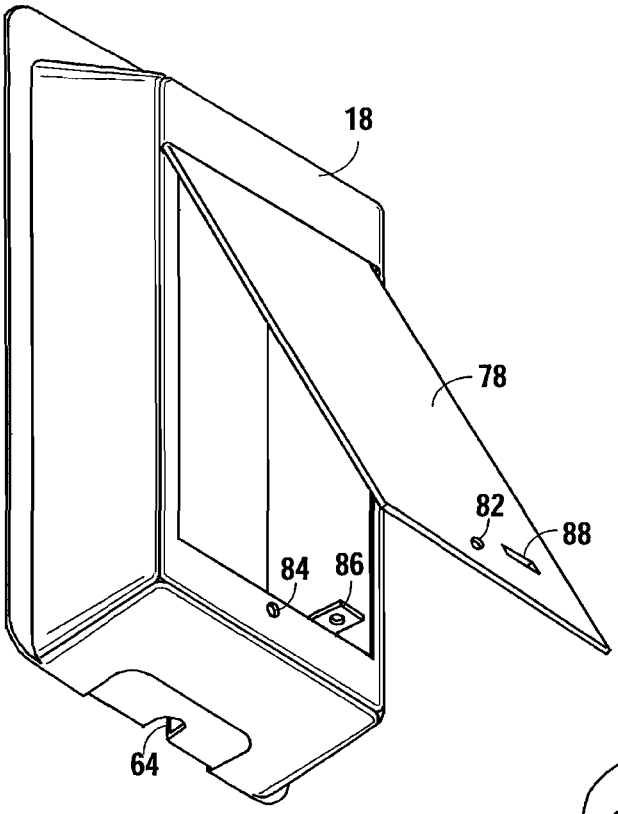
FIG. 6 is an outside perspective view of the electrical disconnect cover and cover door of a ductless system.

After the electrical disconnect cover 18 has been secured in position, electrical cable 36 is clamped by rubber grommet 66 and clamp 72 and the female locking connector 42 mated with the male locking connector 76, the lid 78 may be secured on the electrical disconnect cover 18 (see FIG. 6). The lid 78 has an offset (not shown) that is received in slots 80 (see FIGS. 6 and 8). After the lid 78 is closed, it may secured by a screw (not shown) through screw holes 82 and 84. Tab 86 extends outward through slot 88 in the lid 78 to help ensure that the lid 78 stays in position.

Figure 4:
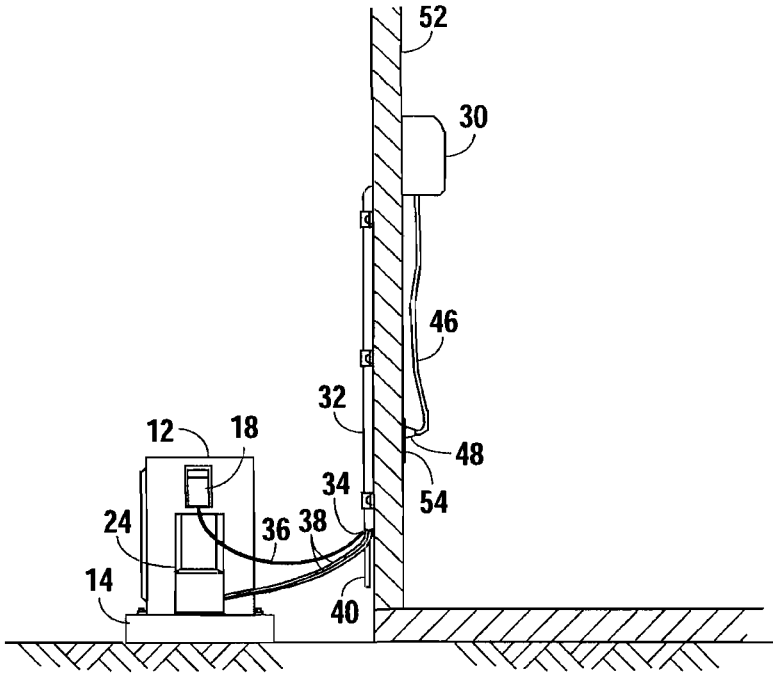
FIG. 4 is a cross-sectional view of a wall of an enclosed space illustrating connections between the indoor unit and the outdoor unit of the ductless system shown in FIG. 1.
Figure 5:
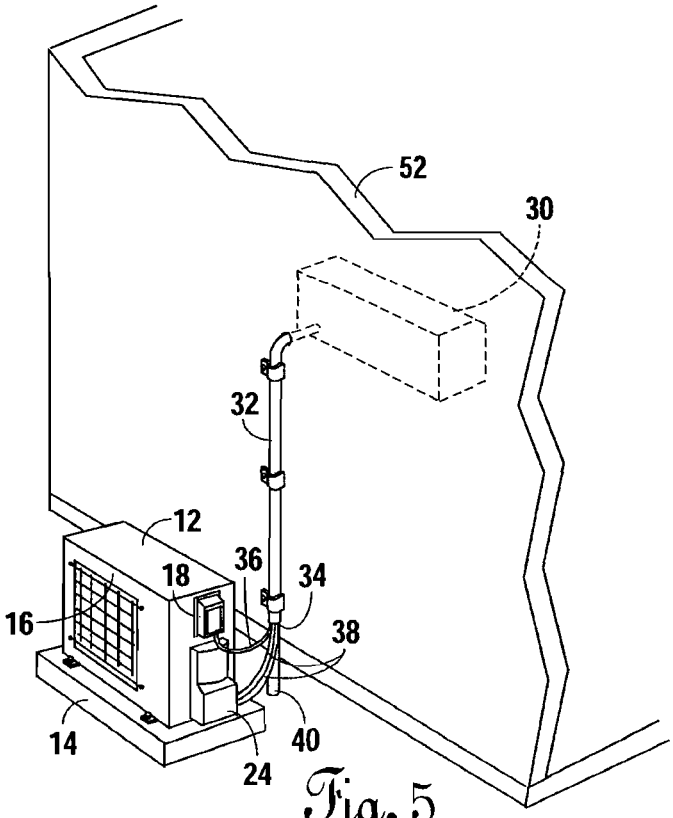
FIG. 5 is a perspective view illustrating the connection of the indoor unit and the outdoor unit of the ductless system shown in FIG. 1.

Referring now to FIGS. 4 and 5 in combination, a typical outdoor unit 12 is shown connected to indoor unit 30 through a cable sheath 32. Out of the lower end 34 of the cable sheath 32 extends dual-refrigerant lines 38, electrical cable 36 and drain line 40. The dual-refrigerant lines 38 connect to the outdoor unit 12 inside of the covering box 24. The covering box 24 helps protect the connections against the elements. The additional electrical disconnect cover 18 (not shown in FIGS. 4 and 5) provides additional insurance that the electrical connection will remain in place and not be a danger of shocking or electrocution.

While the preferred embodiment has shown the inside unit 30 to be mounted on the wall, the inside unit 30 could be anywhere that is convenient, including a stand-alone unit inside the enclosed space. The inside unit 30 could even be mounted in the ceiling. All that the unlicensed person would have to do to install the present system 10 is to cut a single hole of approximately 3 inches in diameter in the wall to extend the cable sheath there through. Immediately outside, the cable sheath can be clamped to the wall and connected to the outside unit. Since the outside unit 12 and inside unit 30 are both pre-charged, there is no need for refrigeration service personnel to come to charge the unit. Also because no electrical box is installed outside, no electrician is necessary to install the system 10. The only "construction" that would have to be done would be to cut the 3 inch hole in the wall for the cable sheath and mount the mounting bracket 28 on the wall 52. Thereafter, it is simply a matter of connecting the dual-refrigeration lines 38 and the electrical cable 36.

If the hole cut in the wall behind the inside unit 30 is too large, it may be weather-sealed with a rubber grommet there around or caulked with suitable caulking material.

While the present system 10 has been described as an HVAC system, it could be just air conditioning or just heating, depending upon the preference of the individual user.

Also, if the individual user desires to bring the drain line 40 out someway other than through the cable sheath 32, that also can be done. For example, the drain line could come straight out through the same hole as the cable sheath 32, but not be inside of cable sheath 32.

By use of the system as just described, a ductless HVAC system can be provided to as many indoor units 30 as are desired with indoor units 30 being located in different rooms. However, if indoor units 30 are connected in parallel, then a licensed refrigerant person might be necessary to recharge the system. However, for systems using a single indoor unit, recharging is not necessary.

Concerning the running of the cable sheath 32, the preferred embodiment shows the cable sheath 32 going through the wall 52 immediately behind the inside unit 30. The cable sheath 32 can go through the wall 52 at any desired location.

Figure 9:
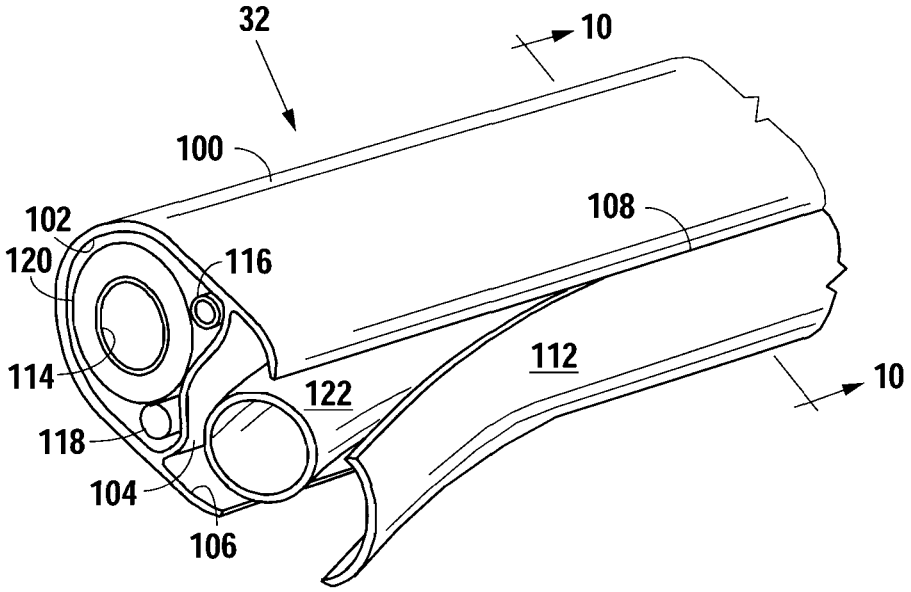
FIG. 9 is a perspective view of one end of a cable sheath with a suction line, liquid line, electrical line and a drain tube contained therein.
Figure 10:
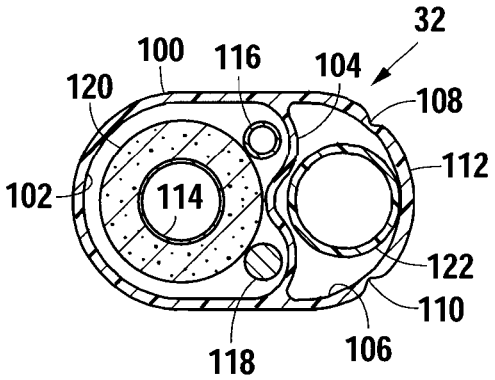
FIG. 10 is a cross-sectional view of FIG. 9 along section lines 10-10.

Referring to FIGS. 9 and 10 in combination, one embodiment of the cable sheath 32 is shown. The cable sheath 32 has an external shell 100 that has a cross-sectional exterior that is oblong with generally circular ends. The external shell has an enlarged opening 102 on one side thereof, a dividing wall 104 and a smaller opening 106 on the opposite side of the dividing wall 102.

The external shell 110 on the side containing the smaller opening 106 has scoring grooves 108 and 110 running longitudinally along the cable sheath 32 so that peel strips 112 may be pulled back as shown in FIG. 9 to expose the smaller opening 106.

Inside of the enlarged opening 102 is contained the refrigerant suction line 114, liquid refrigerant line 116 and the electrical line 118. The refrigerant suction line 114 may have insulation 120 there around. The combination of the refrigerant suction line 114, liquid refrigerant line 116 and electrical line 118 are fed through the enlarged opening 102 of the external shell 100.

In the smaller opening 106 of the external shell 100 is located a drain tube 122. By using the scoring grooves 108 and 110, the peel strips 112 may allow access to one end of the drain tube 102 after it has been pulled through the smaller opening 106. In that manner, the drain tube 122 can be taken to any desired location to get rid of the condensate that may be collected on the inside unit 30 (not shown in FIGS. 9 and 10).

Figure 11:
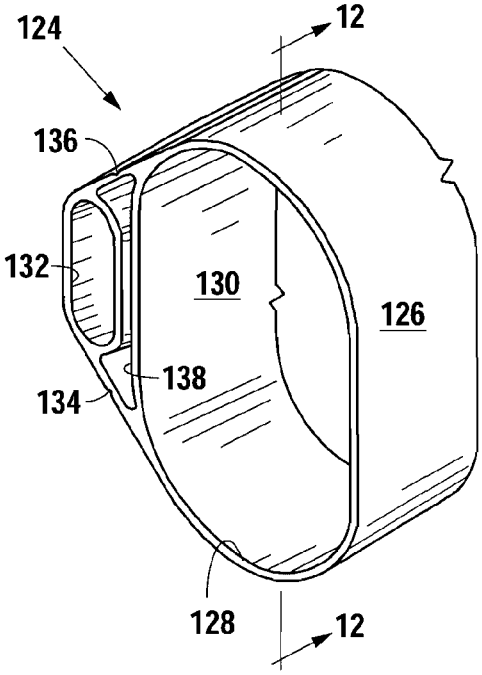
FIG. 11 is a first alternative of a cable sheath.
Figure 12:
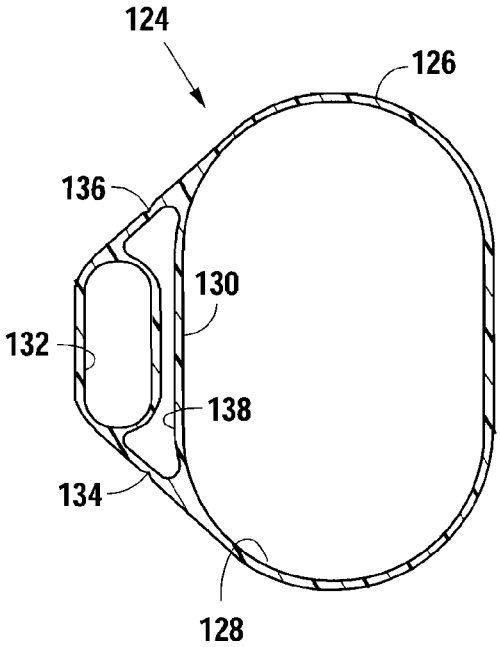
FIG. 12 is a cross-sectional view of FIG. 11 along section lines 12-12.

Referring now to FIGS. 11 and 12 in combination, an alternative cable sheath 124 is shown. The alternative cable sheath 124 has an external shell 126 that has an enlarged opening 128 on one side thereof. A dividing wall 130 separates the enlarged opening from a drain tube 132 formed by the external shell 126. The drain tube has scoring grooves 134 and 136 on either side thereof, which scoring is adjacent to an internal opening between the enlarged opening 128 and the drain tube 132. By use of scoring grooves 134 and 136, the drain tube 132 can be separated from the alternative cable sheath 124 to drain the condensate therein to any particularly desired location.

Figure 13:
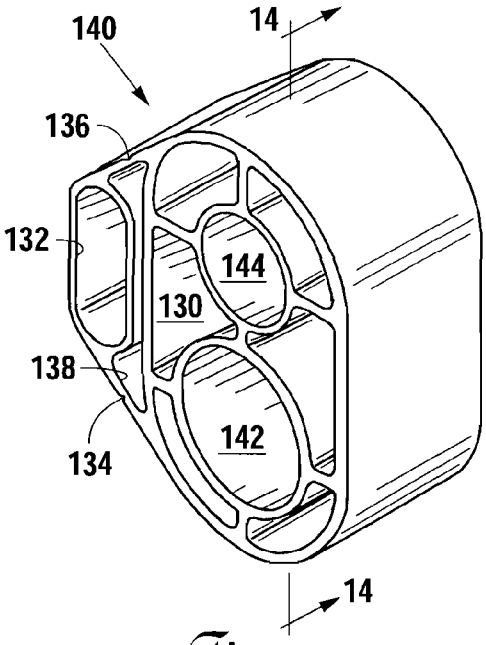
FIG. 13 is a perspective view of a second alternative of a cable sheath.
Figure 14:
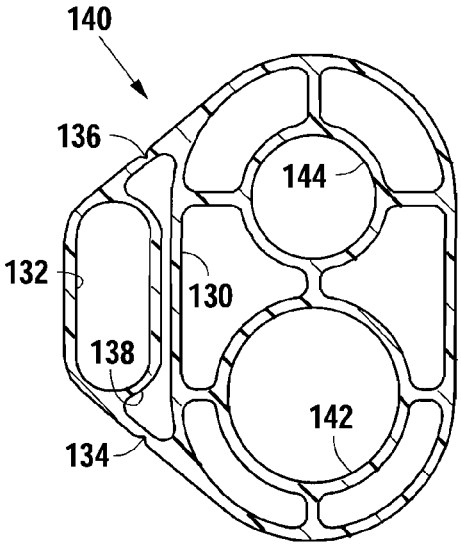
FIG. 14 is a cross-sectional view of FIG. 13 along section lines 14-14.

Referring now to FIGS. 13 and 14 in combination, a second alternative cable sheath 140 is shown. The second alternative cable sheath still has the drain tube 132 with scoring grooves 134 and 136 on either side thereof. Also, internal opening 138 exists between the drain tube 132 and dividing wall 130.

The enlarged opening 128 as shown in connection with FIGS. 11 and 12 has been filled in with hollow spaces surrounding a refrigerant suction line opening 142 and liquid refrigerant line opening 144 in FIGS. 13 and 14. The refrigerant suction line 114 (described in conjunction with FIGS. 11 and 12) would go through the refrigerant suction line opening 142. The liquid refrigerant line 116 (described in FIGS. 11 and 12) would go through the liquid refrigerant line opening 144. The electrical line 118 would go through any of the openings surrounding either the refrigerant suction line opening 142 or the liquid refrigerant line opening 144.

While three different embodiments of a cable sheath have been described in connection with FIGS. 9-14, other embodiments of a cable sheath are possible without diverting from the scope and intent of the present invention.

Figure 15:
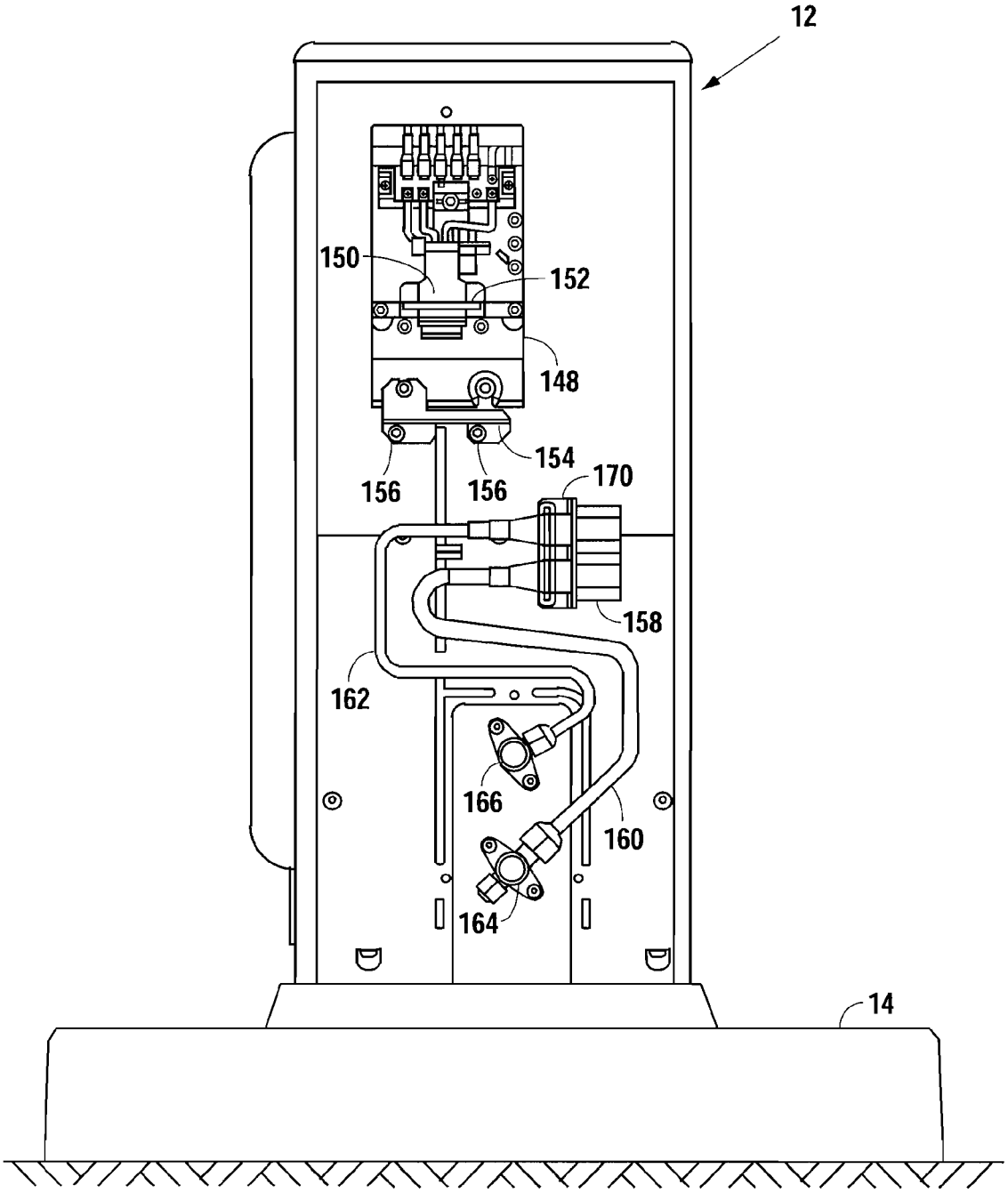
FIG. 15 is an end view of an alternative embodiment of the outside unit with the cover removed.

Referring now to FIG. 15, an end view of the outside unit 12 is shown on the lightweight pad 14. The external connections of the outdoor unit 12 as shown in FIG. 15 are slightly different from the external connections shown in FIGS. 1, 3, 4, 5 and 8.

Figure 16:
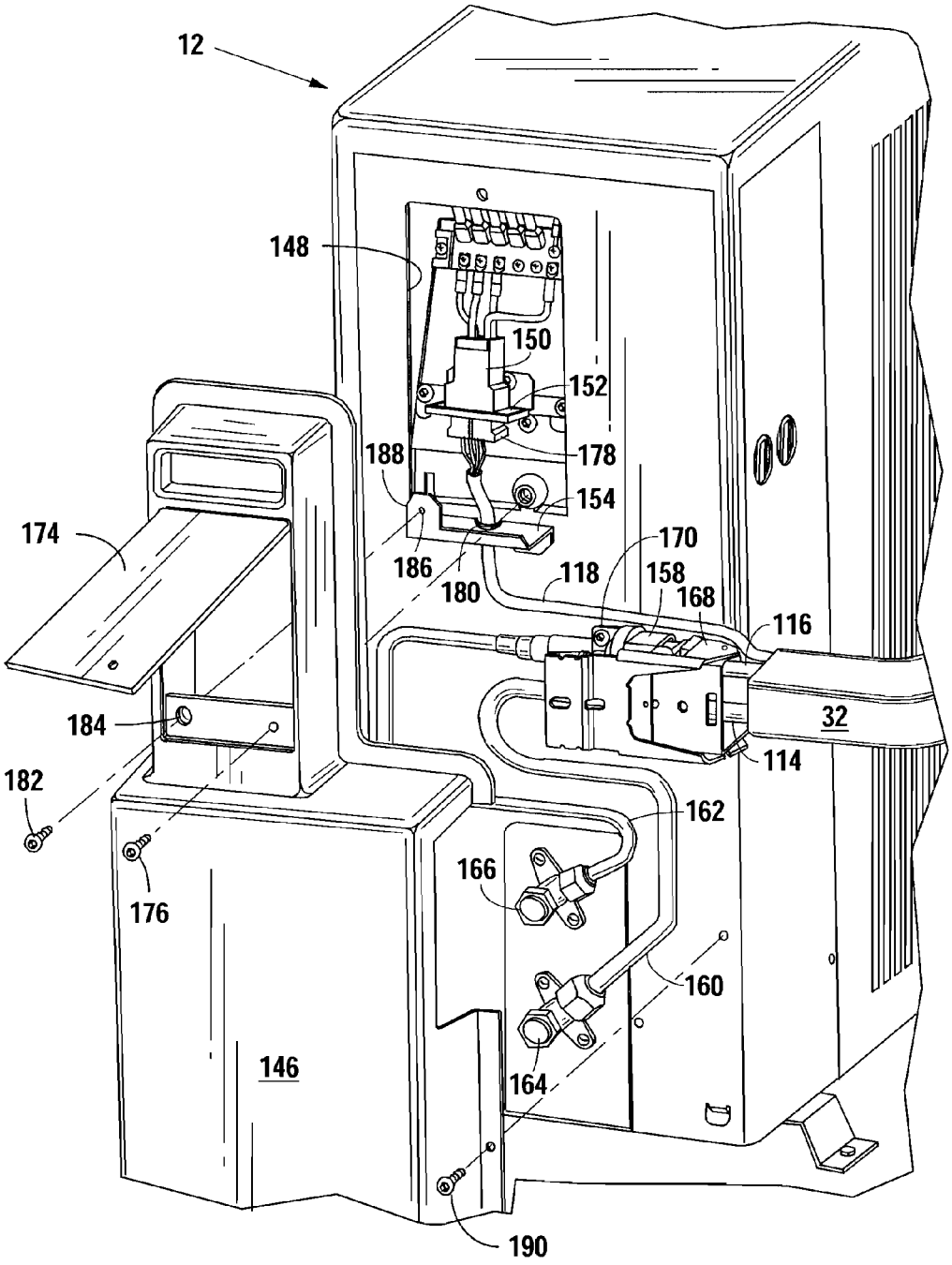
FIG. 16 is a partial perspective end view of the outside unit shown in FIG. 15 with the cover partially exploded therefrom.
Figure 17:
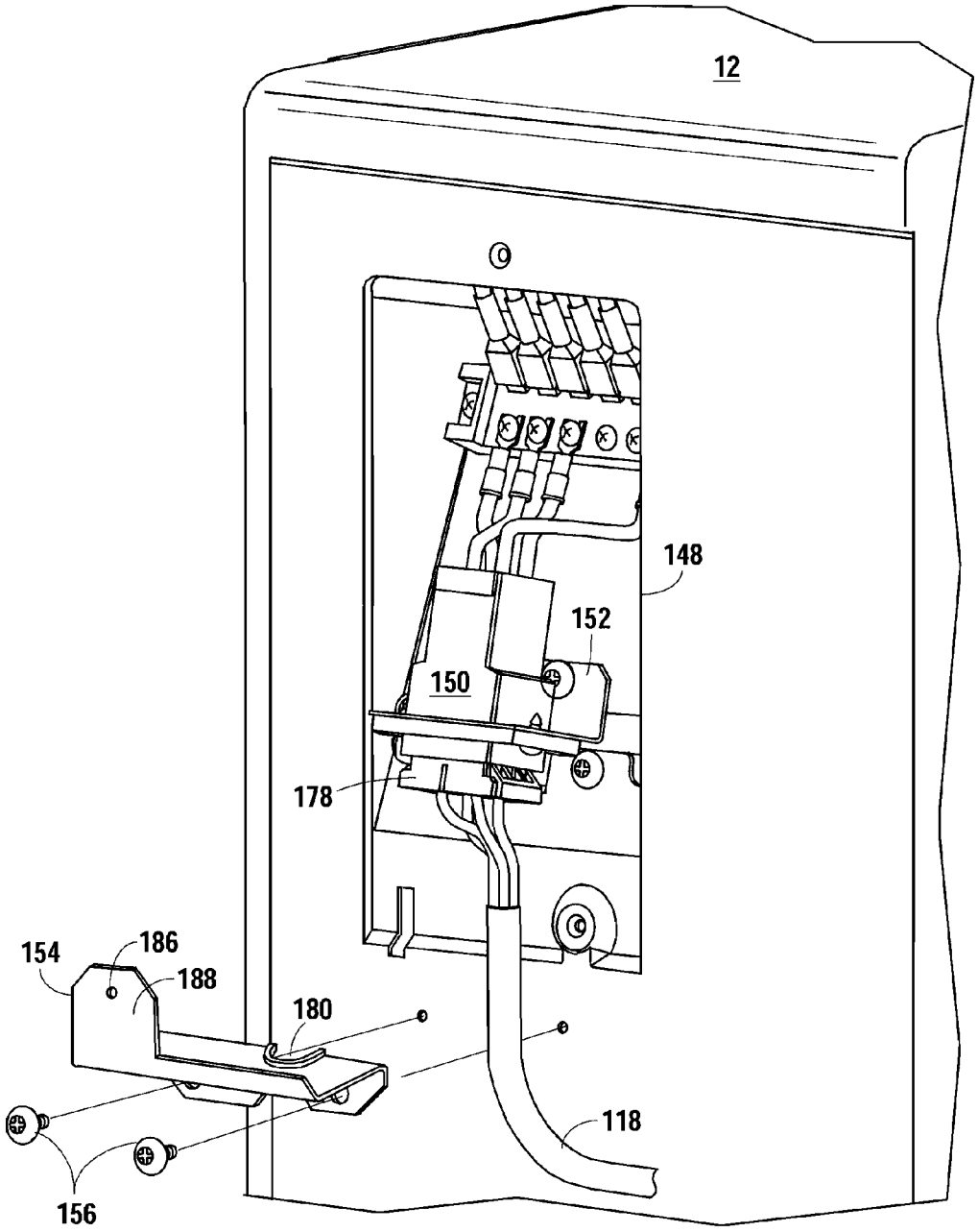
FIG. 17 is a partial perspective end view of the outside unit shown in FIG. 15 with the cord retention bracket exploded therefrom.

Referring to the embodiment of the outdoor unit 12 as shown in FIGS. 15, 16 and 17 in combination, FIG. 15 shows the cover 146 (see FIG. 16) is removed. The outdoor unit 12 as shown in FIG. 15 has nothing connected thereto. In the electrical connection area 148 of the outdoor unit 12 is provided an outdoor unit electrical connection 150 that is held securely in position by holding bracket 152. The outdoor unit electrical connection 150 is a male connector designed to mate with a female connector.

Below the output unit electrical connection 150 is a cord retention bracket 154 held in position on the outdoor unit 12 by mounting screws 156.

Below the electrical connection area 148 is mounted a refrigerant quick disconnect 158. The refrigerant quick disconnect 158 has a refrigerant suction line 160 and a liquid refrigerant line 162 connected thereto. The refrigerant suction line 160 connects to the outdoor unit 12 by elbow connector 164 and liquid refrigerant line 162 connects to the outdoor unit 12 by elbow connector 166.

Referring now to FIGS. 16 and 17 in combination with FIG. 15, like numerals will be used to designate like components. FIG. 16 shows the cover 146 removed so the connections to the outdoor unit 12 can be illustrated. A cable sheath 32 is shown going to the outdoor unit 12 in FIG. 16. The refrigerant is connected via refrigerant quick disconnect 158 via male refrigerant connector 168. The refrigerant suction line 114 and liquid refrigerant line 116 connect through male refrigerant connector 168 to refrigerant quick disconnect 158.

Figure 18:
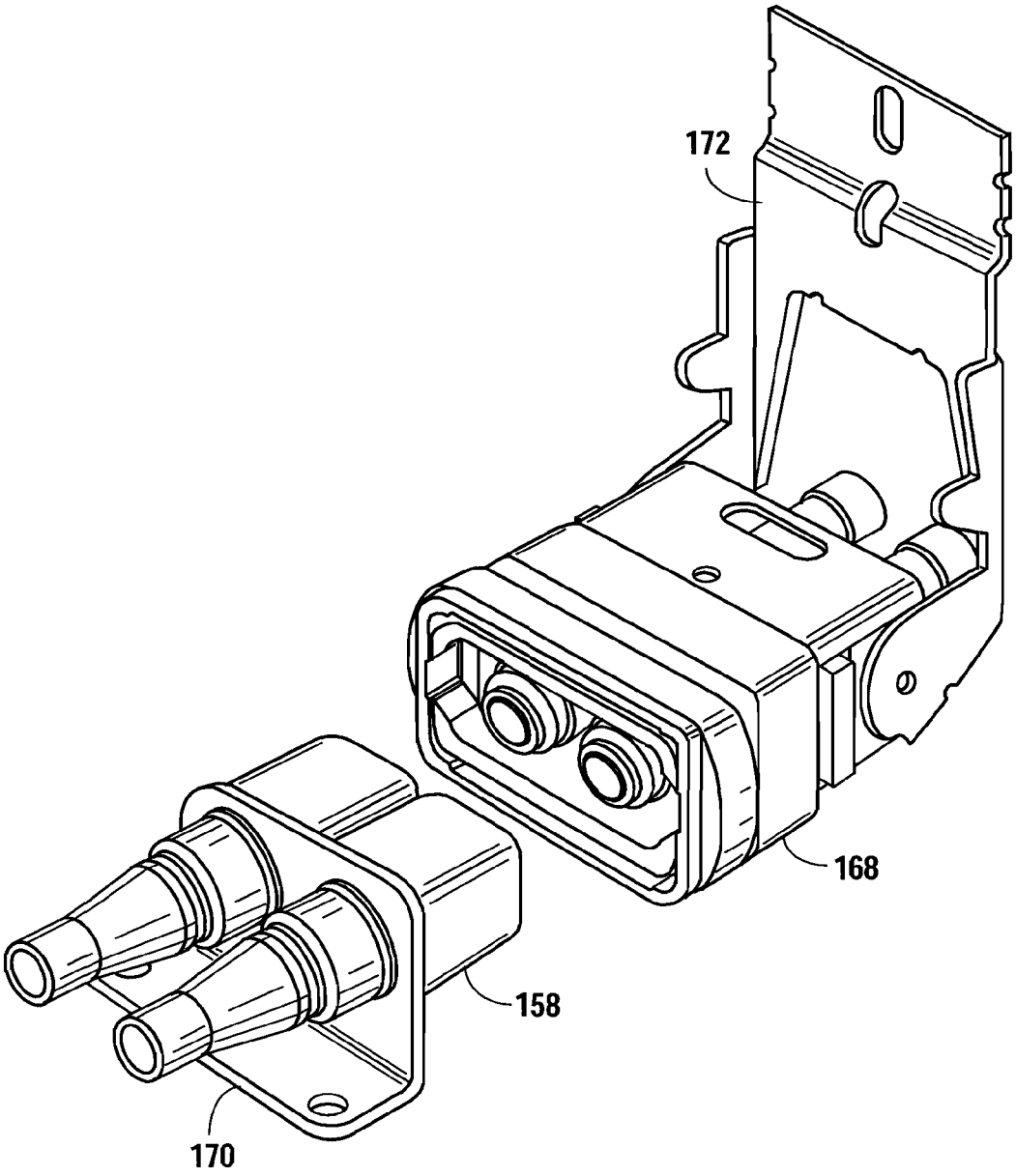
FIG. 18 is a perspective view of the quick disconnect for the refrigerant.
Figure 19:
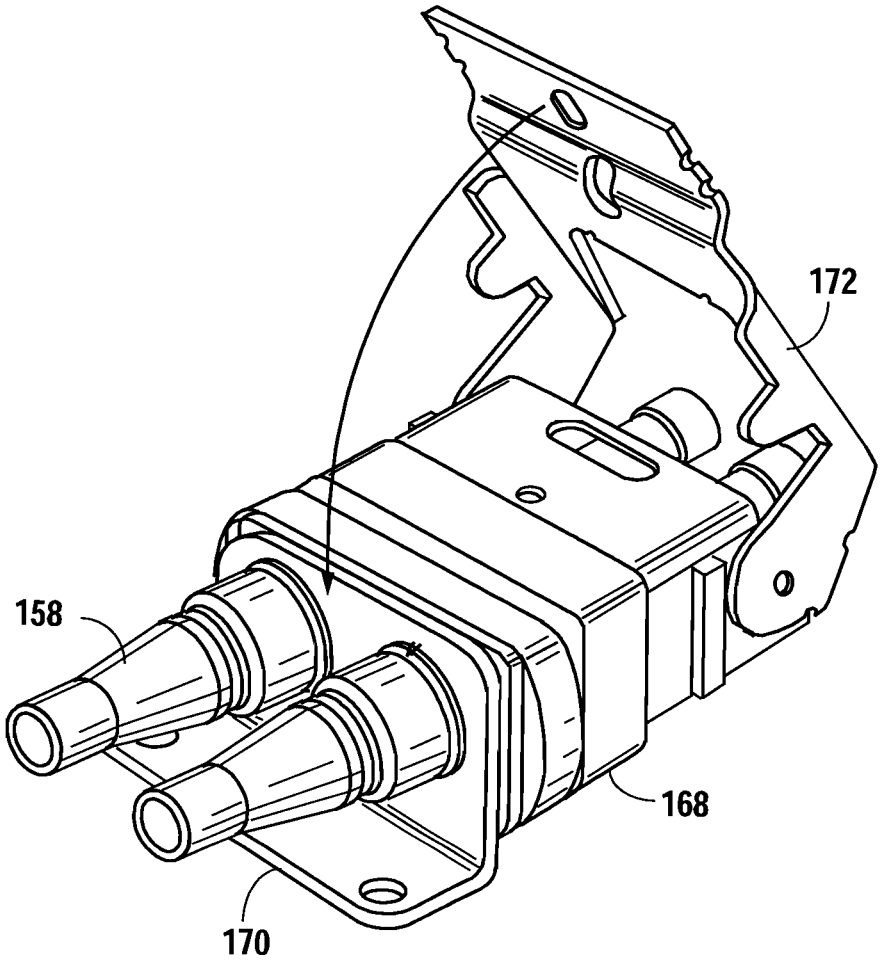
FIG. 19 is a perspective view of the quick disconnect being connected.
Figure 20:
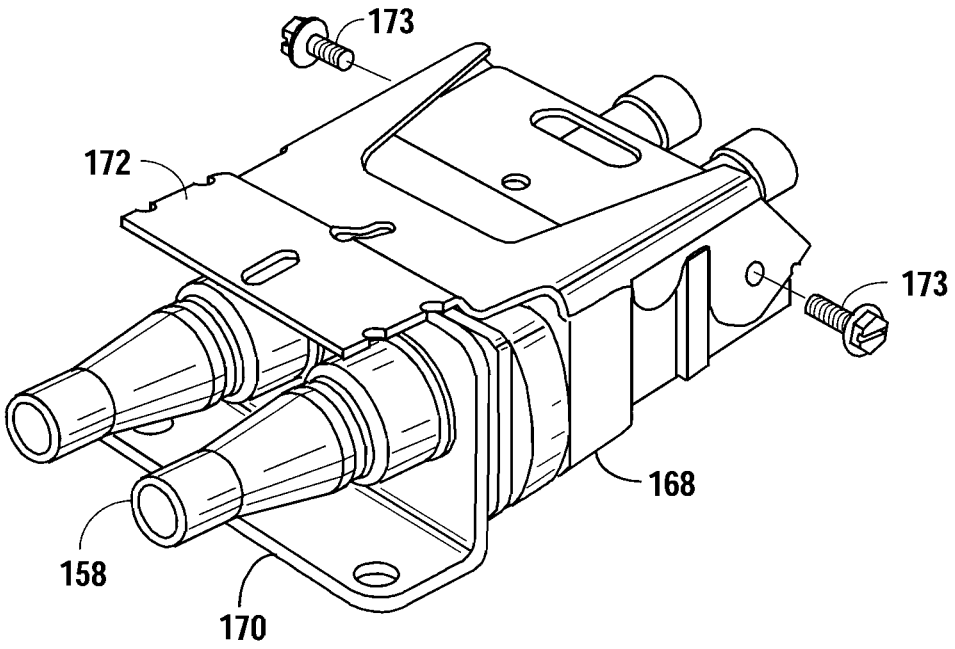
FIG. 20 is a perspective view of the quick disconnect after connection.

Referring to the sequential views shown in FIGS. 18, 19 and 20, a refrigerant quick disconnect is shown. The refrigerant quick disconnect 158 is held in position on the outdoor unit by bracket 170. The male refrigerant connector 168 is shown with the connecting lever 172 raised before the mating of male refrigerant connector 168 with refrigerant quick disconnect 158. Once the male refrigerant connector 168 and the refrigerant quick disconnect 158 come together as shown in FIG. 19, the connecting lever 172 is pushed forward as shown in FIG. 19. Once there is complete mating of the male refrigerant connector 168 with the refrigerant quick disconnect 158 as shown in FIG. 20 with the connecting lever 172 all the way forward, the mating connection can be maintained by inserting anti-tampering screws 173.

Returning now to FIGS. 16 and 17 in combination, the cover 146 has an electrical access panel 174 that must be opened first by removing screw 176. After screw 176 is removed, electrical access panel 174 can be opened as pictorially illustrated in FIG. 16. Then, outdoor electrical connector 150 on outdoor unit 12 can be disconnected from female electrical connector 178. However, female electrical connector 178 which is electrically hot will be held in position just below holding bracket 152 by cord retention bracket 154. Cord retention bracket 154 has a cord retention notch 180 in the bottom thereof that is designed to receive and clamp electrical line 118. The electrical line 118 has three connectors therein; one for power, one for signal and one for ground. The cord retention notch 180 is small enough to squeeze electrical line 118 (which could also have a rubber grommet there around) to securely hold the electrical line 118 and female electrical connector 178 in position.

After the electrical access panel 174 has been opened and the female electrical connector 178 disconnected, then cover screw 182 may be removed. Cover screw 182 is located in recess 184 below electrical access panel 174 and threadably connects to screw hole 186 in tab 188 of cord retention bracket 154. Additional screws 190 may be used around cover 146 to more securely attach it to the outdoor unit 12.

As a safety precaution, cover 146 cannot be installed until cord retention bracket 154 has been installed. Cord retention bracket 154 is not installed until after the female electrical connector has mated with the outdoor unit electrical connection 150. Then, the cord retention bracket 154 is installed by inserting mounting screws 156. Thereafter, the cover 146 will be put in place and screws 190 and cover screw 182 threadably connected to the screw hole 186 in tab 188 of cord retention bracket 154. This insures that the cord retention bracket 154 is in place. Thereafter, electrical access panel 174 may be closed and secured by screw 176.

Figure 21:
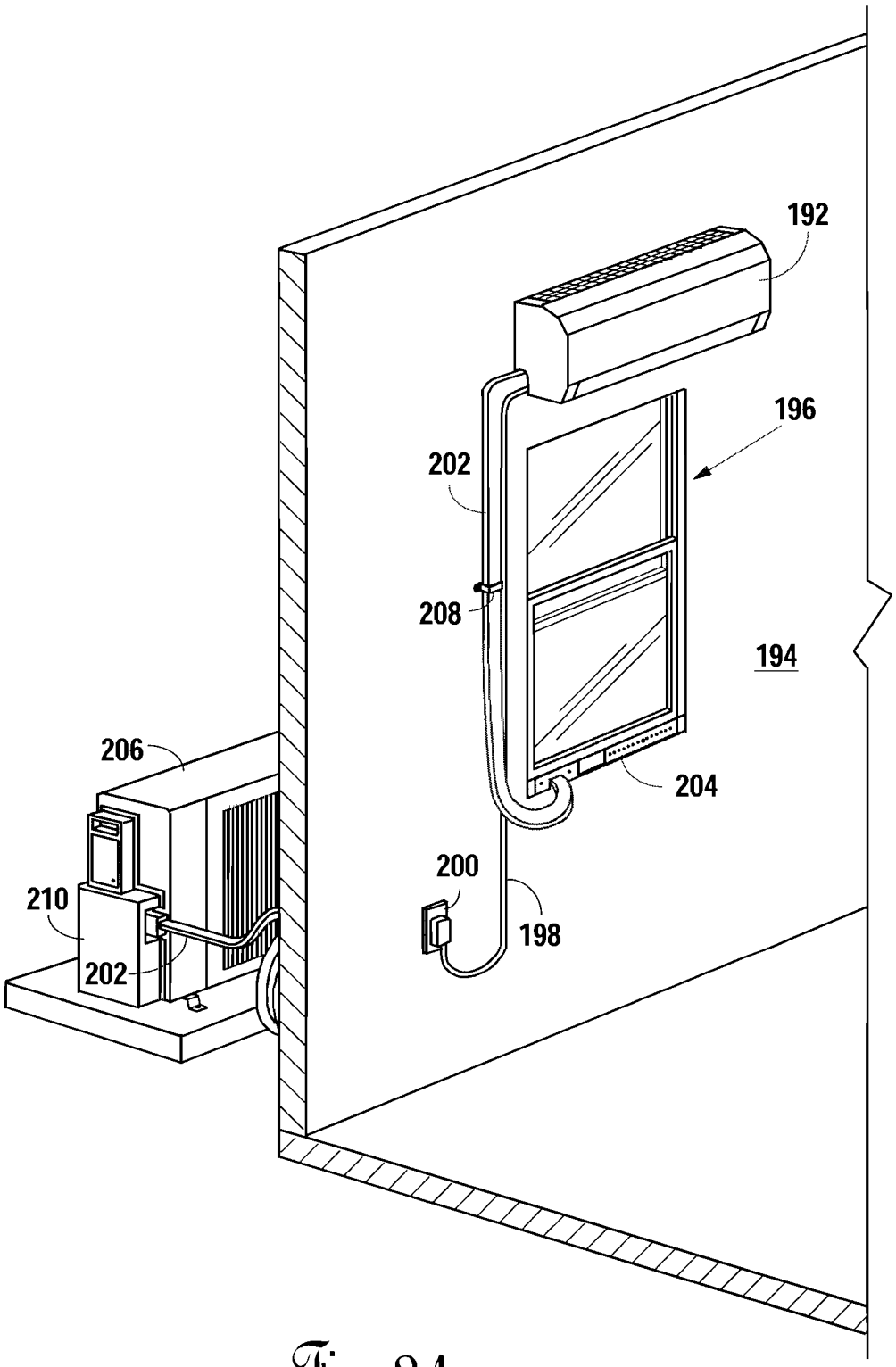

Referring now to FIG. 21, a partial sectional view of an outside wall of an enclosed facility is shown to illustrate the present invention with an inside unit 192 mounted on a wall 194 above a window 196. The inside unit 192 is connected via a power cord 198 to electrical connection 200. The cable sheath 202 goes through a an expandable window sill 204 as will be explained in more detail subsequently to the outside unit 206. The cable sheath 202 is held in position by cable clamps 208. The outside unit 206 has a cover 210 similar to the cover 146 described in conjunction with FIG. 16.

Figure 22:
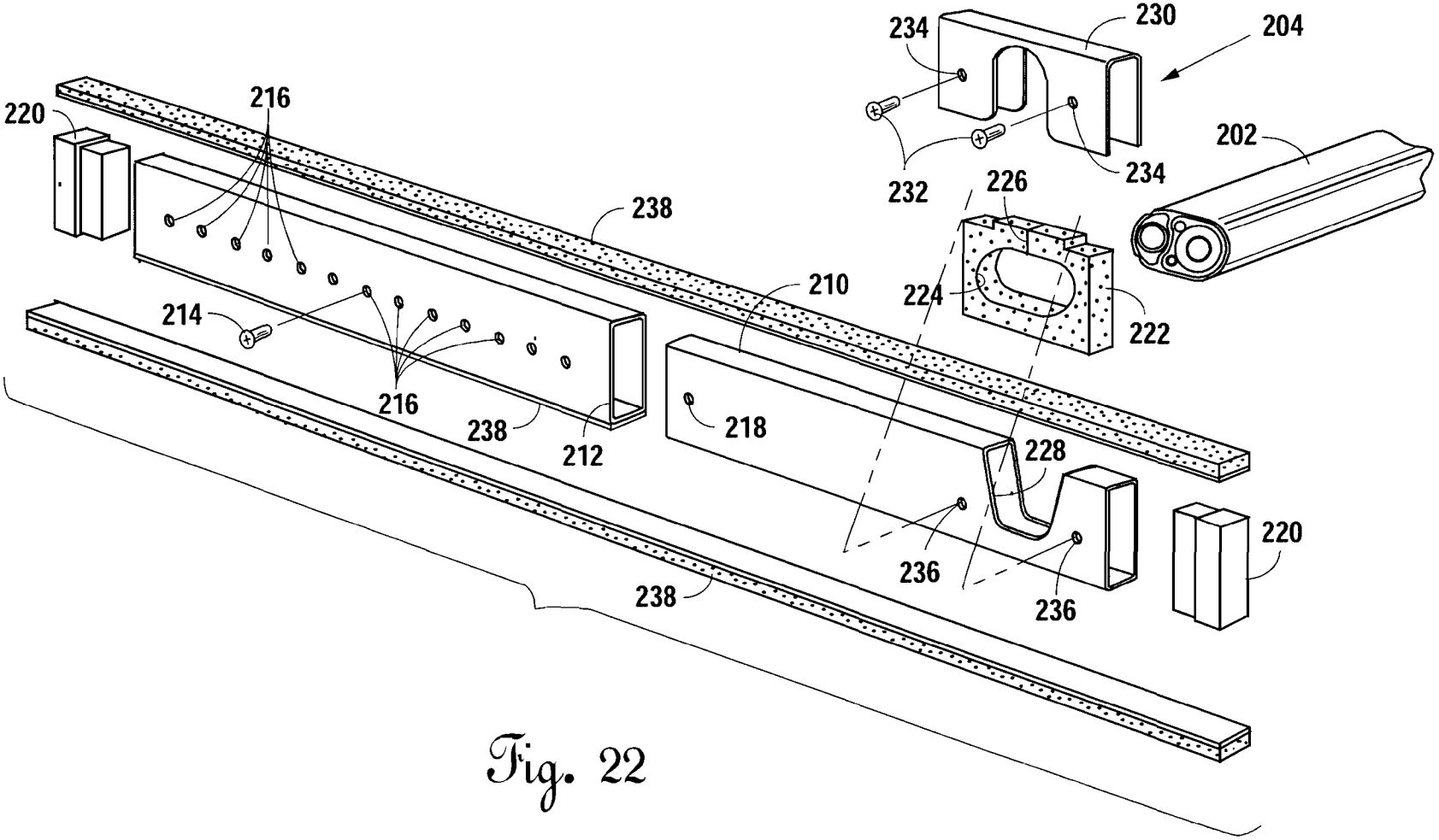
FIG. 22 is an exploded perspective view of the expandable window sill used in FIG. 21.

Referring now to FIG. 22, an exploded perspective view of the expandable window sill 204 is shown. The expandable window sill 204 has an inner extension 210 and outer extension 212 that telescope together. By the telescoping of the inner extension 210 within the outer extension 212, the expandable window sill 204 may be expanded to the width of the window 196 in wall 194 (see FIG. 21). Pin 214 will extend through one of the holes 216 in outer extension 212 to mate with hole 218 in inner extension 210 to snuggly fit the end seals 220 with each side of the window 196.

A piece of flexible foam 222 has an opening 224 therein that matches the cross-sectional configuration of cable sheath 202. A slot 226 cut in the flexible foam 222 allows the cable sheath 202 to slide into opening 224. Then, the flexible foam 202 is inserted inside of inner extension 210 via notch 228 cut therein. To secure the cable sheath 202 in position and to seal the notch 228, sheath clip cover 230 is placed over inner extension 210 where the cable sheath 202 extends there through. Sheath cover pins 232 extend through holes 234 in sheath clip cover 230 and holes 236 in inner extension 210 to securely hold everything in place. Strips of foam 238 or other suitable flexible material are located on both sides of the expandable window sill 204 to complete a sealing with the window 196.

Figure 23:
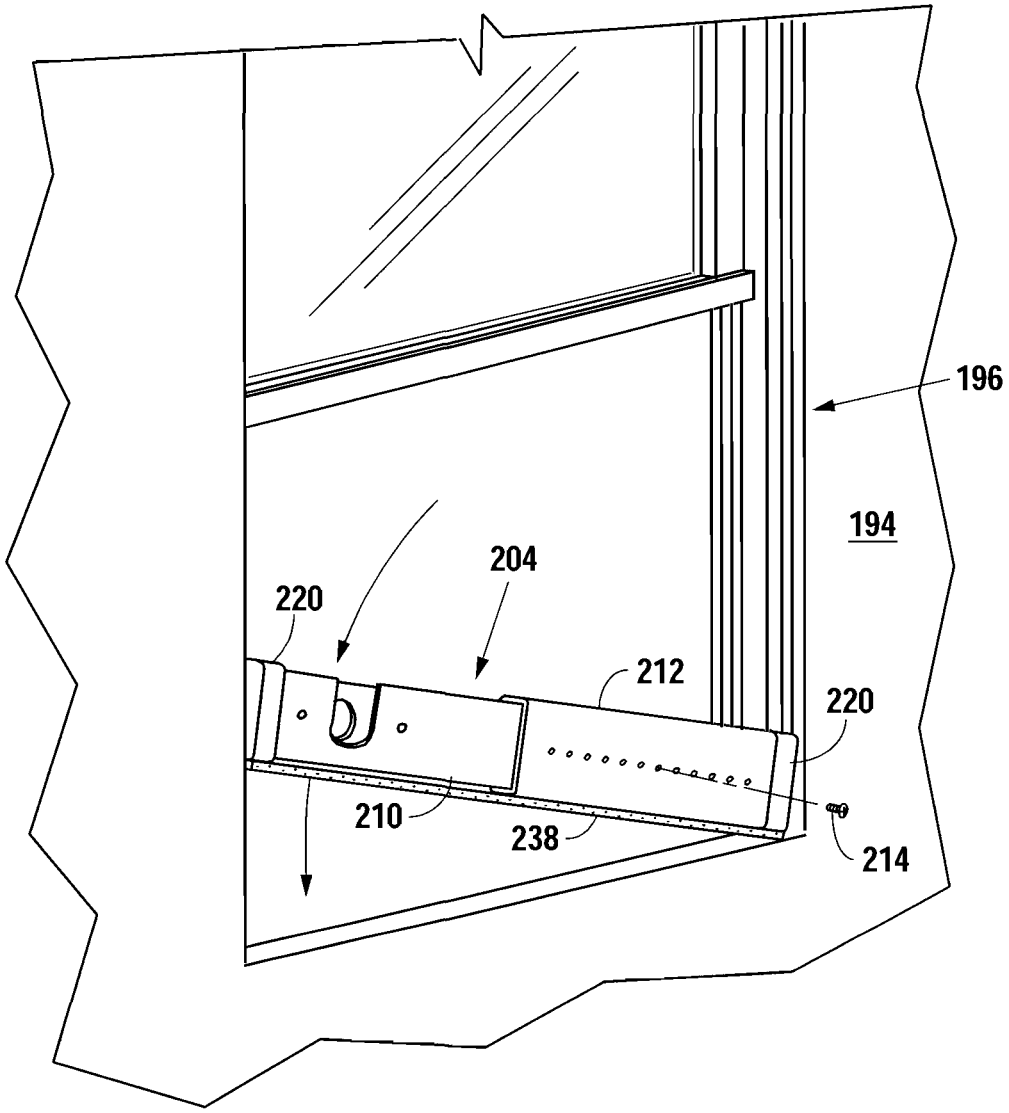
FIG. 23 is an illustrated perspective view showing the simple sill being installed.
Figure 24:
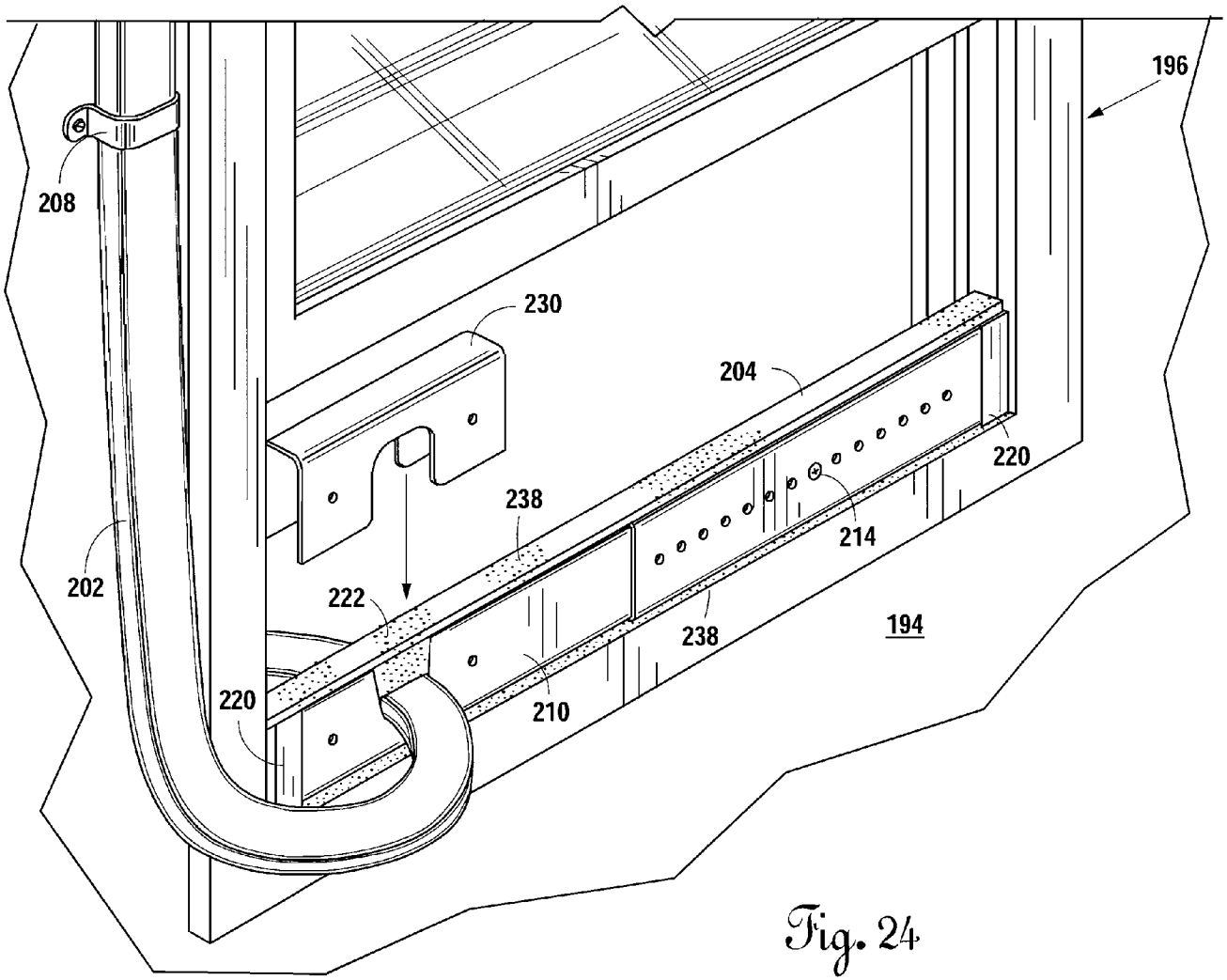
FIG. 24 is a perspective view showing the final installation step of the simple sill.

Referring to FIGS. 23 and 24 in sequence, the expandable window sill 204 is shown being inserted in window 196 of wall 194. The inner extensions 210 is being adjusted with respect to the outer extension 212 by pin 214 to make sure the end seals 220 securely seal to each side of the frame of window 196. The lower foam strip 238 is cut to the same width as the window 196 and put in place. After installing as shown in FIG. 23, the cable sheath 202 is inserted in the flexible foam 222 and inserted into the inner extension 210. The sheath clip cover 230 is then secured in position as is illustrated. The cable sheath 202 is held in position by cable clips 208. Upper form strips 238 cut to the same width as window 196 completes the sealing of window 196.

By use of an expandable window sill as just described, an existing window opening can be used to connect an inside unit 192 to an outside unit 206 with a minimum variation from the normal aesthetics of an enclosed space.

What we claim is:

1. A ductless, pre-charged HVAC system for installation by unlicensed personnel, said HVAC system to condition air within an enclosed space having walls there around, said HVAC system comprising:

a pre-charged outdoor unit including an outdoor coil, an outdoor fan for drawing outside air through said outdoor coil, a compressor and a reversing valve;

a pre-charged indoor unit including an indoor coil, an indoor fan for drawing inside air through said indoor unit and a filter for filtering the inside air;

a cable sheath for connecting said indoor unit to said outdoor unit through an opening in said wall, said cable sheath including dual refrigerant lines for supplying refrigerant between said indoor coil and said outdoor coil, an electrical cable for supplying power to said outdoor unit from said indoor unit and a drain line from said indoor coil to outside said enclosed space;

power cord for connecting said indoor unit to an electrical outlet;

quick refrigerant connector between said dual refrigerant lines and said outdoor unit to allow refrigerant to flow back and forth between said outside unit and said inside unit;

connector cover on said outdoor unit receiving an electrical connector end of said electrical cable therein and a bracket holding said electrical connector end of said electrical cable inside said connector cover, said electrical connector end connecting to an outdoor power plug of said outdoor unit, said electrical connector end and said outdoor power plug being secured under said connector cover, said connector cover has a lid to allow access to said electrical connector end and said outdoor power plug without removing said connector cover.

2. The ductless, pre-charged HVAC system as recited in claim 1 wherein said bracket clamps said electrical connector end of electric cable in place even when said electrical cable and said outdoor power plug are disconnected to keep said electrical connector end from dropping down and causing a short.

3. The ductless, pre-charged HVAC system as recited in claim 2 wherein said lid to bracket must be opened before said connector cover can be moved thereby allowing said electrical connector end of said electrical cable to be disconnected first.

4. The ductless, pre-charged HVAC system as recited in claim 3 wherein said bracket has a mouse hole therein to hold said electrical cable in place.

5. The ductless, pre-charged HVAC system as recited in claim 1 wherein said drain line is separated from said cable sheath outside said enclosed space to dispose of condensate.

6. The ductless, pre-charged HVAC system as recited in claim 1 wherein said system includes a telescoping sill with a notch therein for holding said cable sheath therein under a window in said wall, said telescoping sill being locked in position with a pin.

7. The ductless, pre-charged HVAC system as recited in claim 6 wherein said telescoping sill has a flexible material there around to seal said window, including around said cable sheath.

8. The ductless, pre-charged HVAC system as recited in claim 1 wherein said cable sheath has a large chamber for said dual refrigerant lines and said electrical cable and a small chamber for said drain line.

9. The ductless pre-charged HVAC system as recited in claim 8 wherein said cable sheath has scoring lengthwise thereof to allow said drain line to be separated outside said enclosed space from the remainder of said cable sheath to dispose of condensate.

10. A method of installation of a ductless, pre-charged HVAC system by unlicensed personnel to condition air of an enclosed space having walls there around and at least one vertically moveable window in said walls, said method including the following steps:

selecting a location for an inside unit on said wall, said inside unit including an inside coil, inside fan for drawing inside air through said inside coil before discharging into said enclosed space and filters for filtering said inside air;

sealing an expandable window sill adjacent said window, said telescoping sill having a sealable notch therein large enough to receive there through from said indoor unit a cable sheath with an electrical cable, dual refrigerant lines and a drainage line therein;

mounting said indoor unit on one of said walls;

extending said cable sheath with electrical cable, dual refrigerant lines and said drainage line through said sealable notch;

securing said outdoor unit to a lightweight shipping pad;

placing said outdoor unit and said lightweight shipping pad outside said enclosed space but near said window;

first connecting outside dual ends of said dual refrigerant lines to a dual refrigerant connector mounted on said outdoor unit with a quick refrigerant connector;

second connecting an outside female end of said electrical cable to a male electrical connector mounted on said outdoor unit;

clamping with a bracket said electrical cable near said outside female end to prevent said female end from reaching the ground when unplugged;

covering with a cover said outside dual ends of said refrigerant lines and said outside female end of said electrical cable when connected; and plugging said inside unit into an electrical outlet and turning the HVAC system ON.

11. The method of installation of a ductless, pre-charged HVAC by unlicensed personnel as recited in claim 10 wherein said covering step includes attaching said cover to said bracket and thereafter closing a lid that allows access to electrical connections to said outside unit.

12. The method of installation of a ductless, pre-charged HVAC by unlicensed personnel as recited in claim 11 wherein said bracket holds said electrical cable near said outside female end in position even when electrically disconnected.

13. The method of installation of a ductless, pre-charged HVAC by unlicensed personnel as recited in claim 10 wherein said dual refrigerant lines and said electrical cable are retained inside said cable sheath which terminates adjacent said outside unit.

14. The method of installation of ductless, pre-charged HVAC by unlicensed personnel as recited in claim 13 wherein said drainage line is removable on each end thereof by scoring along said cable sheath thereby allowing condensate from said drainage line to drop to the ground.

15. The method of installation of ductless, pre-charged HVAC by unlicensed personnel as recited in claim 14 wherein said cable sheath is inserted in said sealable notch, a flexible material sealing said sealable notch and a sheath clip cover covering said sealable notch.

* * * * *